US007290299B2

(12) United States Patent
Votel

(10) Patent No.: US 7,290,299 B2
(45) Date of Patent: Nov. 6, 2007

(54) DEVICE AND METHOD FOR POSITIONING PATIENTS

(76) Inventor: Thomas W. Votel, 1493 Summit Ave., St. Paul, MN (US) 55105

( * ) Notice: Subject to any disclaimer, the term of this patent is extended or adjusted under 35 U.S.C. 154(b) by 0 days.

(21) Appl. No.: 11/032,681

(22) Filed: Jan. 10, 2005

(65) Prior Publication Data

US 2005/0150044 A1 Jul. 14, 2005

(51) Int. Cl.
*A61G 7/14* (2006.01)

(52) U.S. Cl. ..... 5/81.1 HS

(58) Field of Classification Search ..... 5/81.1 HS, 5/81.1 R, 81.1 T, 83.1, 84.1, 88.1, 89.1
See application file for complete search history.

(56) References Cited

U.S. PATENT DOCUMENTS

| | | | | |
|---|---|---|---|---|
| 378,220 | A | 2/1888 | Staples | |
| 716,886 | A | 12/1902 | Goode | |
| 1,085,879 | A | 2/1914 | Skeffington | |
| 1,139,526 | A | 5/1915 | Holicky | |
| 1,263,611 | A | 4/1918 | Scroggin | |
| 1,487,150 | A * | 3/1924 | Deakins | 5/88.1 |
| 1,487,171 | A | 3/1924 | Vigne | |
| 1,620,298 | A | 3/1927 | Smith | |
| 1,815,006 | A | 4/1931 | Horsting | |
| 2,093,231 | A | 9/1937 | Broadwell | |
| 2,177,986 | A | 10/1939 | James | |
| 2,291,444 | A | 7/1942 | Bengtson | |
| 2,392,083 | A | 1/1946 | Dumbleton | |
| 2,439,066 | A | 4/1948 | Vanderlyn | |
| 2,487,648 | A | 11/1949 | Green | |
| 2,498,853 | A | 2/1950 | Hassold | |
| 2,528,048 | A | 10/1950 | Gilleland | |
| 2,536,707 | A | 1/1951 | Allyn | |
| 2,565,761 | A | 8/1951 | Dean | |
| 2,630,583 | A | 3/1953 | Gilleland | |
| 2,632,619 | A | 3/1953 | Wilson | |
| 2,665,432 | A | 1/1954 | Butler | |
| 2,710,975 | A | 6/1955 | Stoen | |
| 2,733,452 | A | 2/1956 | Tanney | |
| 2,745,163 | A | 5/1956 | Vam | |
| 2,761,153 | A | 9/1956 | Mew | |
| 2,812,524 | A | 11/1957 | Pruitt | |
| 2,826,766 | A | 3/1958 | Stoner | |
| 2,827,642 | A | 3/1958 | Huff | |

(Continued)

FOREIGN PATENT DOCUMENTS

| | | |
|---|---|---|
| CH | 660123 | 12/1978 |

(Continued)

*Primary Examiner*—Robert Canfield
*Assistant Examiner*—Gay Anh Spahn
(74) *Attorney, Agent, or Firm*—Patterson, Thuente, Skaar & Christensen, P.A.

(57) ABSTRACT

A patient pull-up system is provided which enables a single operator to reposition a patient situated on a patient support, such as a bed, cart, gurney, or table, from a slumped position to a more upright position nearer the head of the patient support. The repositioning event is accomplished with minimal risk of injury or discomfort to the operator and patient. The patient pull-up system includes a translating device, a frame member, and a clamp adapted to grasp a portion of a sheet situated between a patient and a patient support.

17 Claims, 7 Drawing Sheets

U.S. PATENT DOCUMENTS

| | | | | |
|---|---|---|---|---|
| 2,860,352 | A | | 11/1958 | Pierre |
| 2,939,195 | A | | 6/1960 | Carlson |
| 2,959,412 | A | | 11/1960 | Sjostrom |
| 2,959,792 | A | | 11/1960 | Haugard |
| 2,979,737 | A | | 4/1961 | Pierre |
| 3,099,842 | A | | 8/1963 | Jensen |
| 3,108,290 | A | | 10/1963 | Partridge |
| 3,140,069 | A | | 7/1964 | McBurney et al. |
| 3,154,340 | A | | 10/1964 | Lowell |
| 3,165,760 | A | | 1/1965 | Abajian |
| 3,167,788 | A | | 2/1965 | Murphy |
| 3,167,789 | A | | 2/1965 | Wicks |
| 3,259,922 | A | | 7/1966 | Fischer |
| 3,284,816 | A | * | 11/1966 | Laubsch ..... 5/81.1 T |
| 3,289,685 | A | | 12/1966 | Parker |
| 3,294,247 | A | | 12/1966 | Norrington |
| 3,302,219 | A | | 2/1967 | Harris |
| 3,317,928 | A | | 5/1967 | Root |
| 3,363,269 | A | | 1/1968 | Kossuth |
| 3,364,506 | A | | 1/1968 | Hale |
| 3,383,717 | A | | 5/1968 | Underwood |
| 3,392,410 | A | | 7/1968 | Grahn |
| 3,413,663 | A | | 12/1968 | Swann |
| 3,417,765 | A | | 12/1968 | Slater |
| 3,418,670 | A | | 12/1968 | Morgan |
| 3,451,070 | A | | 6/1969 | Danielson |
| 3,451,071 | A | * | 6/1969 | Whiteley ..... 5/630 |
| 3,452,371 | A | | 7/1969 | Hirsch |
| 3,458,878 | A | * | 8/1969 | Combs ..... 5/81.1 T |
| 3,506,985 | A | | 4/1970 | Lang |
| 3,506,988 | A | | 4/1970 | Saddoris |
| 3,521,308 | A | | 7/1970 | Fowler |
| 3,562,824 | A | | 2/1971 | White |
| 3,593,351 | A | | 7/1971 | Dove |
| 3,597,774 | A | | 8/1971 | Warren |
| 3,669,133 | A | | 6/1972 | Hyman |
| 3,730,544 | A | | 5/1973 | Hyman |
| 3,750,199 | A | | 8/1973 | Spivey |
| 3,769,642 | A | | 11/1973 | Warman |
| 3,775,784 | A | | 12/1973 | Fry |
| 3,779,474 | A | | 12/1973 | Harelson |
| 3,781,929 | A | | 1/1974 | Stevens |
| 3,794,313 | A | | 2/1974 | Berger |
| 3,810,263 | A | | 5/1974 | Taylor |
| 3,827,089 | A | | 8/1974 | Grow |
| 3,829,914 | A | | 8/1974 | Treat |
| 3,849,813 | A | | 11/1974 | Neilson |
| 3,859,677 | A | | 1/1975 | Nordwig |
| 3,866,619 | A | | 2/1975 | Per Frisk |
| 3,874,010 | A | | 4/1975 | Geary |
| 3,877,089 | A | | 4/1975 | Spivey |
| 3,884,225 | A | | 5/1975 | Witter |
| 3,895,403 | A | | 7/1975 | Davis |
| 3,905,055 | A | | 9/1975 | Blair |
| 3,924,281 | A | | 12/1975 | Gibbs |
| 3,938,203 | A | | 2/1976 | Linard |
| 3,963,037 | A | | 6/1976 | Clark |
| 4,011,609 | A | | 3/1977 | Bethlen |
| 4,012,799 | A | | 3/1977 | Rutherford |
| 4,038,572 | A | | 7/1977 | Hanagan |
| 4,038,727 | A | | 8/1977 | Robbins |
| 4,051,565 | A | | 10/1977 | Berge |
| 4,068,770 | A | | 1/1978 | Boehringer |
| 4,070,721 | A | | 1/1978 | Stasko |
| 4,077,073 | A | | 3/1978 | Koll |
| 4,092,748 | A | | 6/1978 | Ewers |
| 4,125,908 | A | | 11/1978 | Vail |
| 4,156,946 | A | | 6/1979 | Attenburrow |
| 4,161,044 | A | | 7/1979 | Bogle |
| 4,180,879 | A | | 1/1980 | Mann |
| 4,194,253 | A | | 3/1980 | Ullven |
| 4,195,375 | A | | 4/1980 | Paul |
| 4,202,063 | A | | 5/1980 | Murray |
| 4,222,132 | A | | 9/1980 | Crim et al. |
| 4,259,756 | A | | 4/1981 | Pace |
| 4,262,375 | A | | 4/1981 | Lilienthal |
| 4,270,234 | A | | 6/1981 | James |
| 4,274,168 | A | | 6/1981 | Depowski |
| 4,281,564 | A | | 8/1981 | Hill, deceased |
| 4,296,509 | A | | 10/1981 | Simmons |
| 4,327,453 | A | | 5/1982 | Sefton |
| 4,361,918 | A | | 12/1982 | Roisaeth |
| 4,403,641 | A | | 9/1983 | Reeder |
| 4,416,511 | A | | 11/1983 | Weinberg |
| 4,459,712 | A | | 7/1984 | Pathan |
| 4,479,993 | A | | 10/1984 | James |
| 4,490,867 | A | | 1/1985 | Gabrielsson |
| 4,498,205 | A | | 2/1985 | Hino |
| 4,500,127 | A | | 2/1985 | Van Derlin |
| 4,502,169 | A | | 3/1985 | Persson |
| 4,520,518 | A | | 6/1985 | Reaser |
| 4,536,903 | A | | 8/1985 | Parker |
| 4,558,847 | A | | 12/1985 | Coates |
| 4,627,122 | A | | 12/1986 | Hopp |
| 4,631,761 | A | | 12/1986 | Lederman |
| 4,635,308 | A | | 1/1987 | Maggio |
| 4,644,595 | A | | 2/1987 | Daniel |
| 4,660,240 | A | | 4/1987 | Hutton |
| 4,662,016 | A | | 5/1987 | Seeman |
| 4,679,259 | A | | 7/1987 | DiMatteo et al. |
| 4,680,818 | A | | 7/1987 | Ooka et al. |
| 4,681,279 | A | | 7/1987 | Nakamura |
| 4,686,748 | A | | 8/1987 | Kaivanto |
| 4,688,304 | A | | 8/1987 | Marcott |
| 4,696,025 | A | | 9/1987 | Taylor |
| 4,698,880 | A | | 10/1987 | Hamm |
| 4,700,415 | A | | 10/1987 | DiMatteo et al. |
| 4,700,417 | A | | 10/1987 | McGovern |
| 4,716,607 | A | | 1/1988 | Johansson |
| 4,726,082 | A | | 2/1988 | DiMatteo |
| 4,739,526 | A | | 4/1988 | Hollick |
| 4,747,170 | A | | 5/1988 | Knouse |
| 4,761,841 | A | | 8/1988 | Larsen |
| 4,776,047 | A | | 10/1988 | DiMatteo |
| 4,782,543 | A | | 11/1988 | Hutton |
| 4,787,104 | A | | 11/1988 | Grantham |
| 4,794,660 | A | | 1/1989 | Hawkrigg |
| 4,796,313 | A | | 1/1989 | DiMatteo |
| 4,809,377 | A | | 3/1989 | Lynn |
| 4,809,725 | A | | 3/1989 | Champigny |
| 4,819,283 | A | | 4/1989 | DiMatteo |
| 4,821,352 | A | | 4/1989 | DiMatteo |
| 4,829,617 | A | | 5/1989 | Dameron |
| 4,837,872 | A | | 6/1989 | DiMatteo |
| 4,837,873 | A | | 6/1989 | DiMatteo |
| 4,840,363 | A | | 6/1989 | McConnell |
| 4,843,665 | A | | 7/1989 | Cockel |
| 4,850,562 | A | | 7/1989 | Mazzanti |
| 4,868,938 | A | | 9/1989 | Knouse |
| 4,868,940 | A | | 9/1989 | Masadi |
| 4,872,226 | A | | 10/1989 | Lonardo |
| 4,887,325 | A | | 12/1989 | Tesch |
| 4,908,889 | A | * | 3/1990 | Lonardo ..... 5/81.1 T |
| 4,908,890 | A | | 3/1990 | Beckman |
| 4,918,771 | A | | 4/1990 | James |
| 4,920,590 | A | | 5/1990 | Weiner |
| 4,926,512 | A | | 5/1990 | Coyle |
| 4,937,901 | A | | 7/1990 | Brennan |
| 4,937,904 | A | | 7/1990 | Ross |
| 4,939,801 | A | | 7/1990 | Schaal |
| 4,941,220 | A | | 7/1990 | DiMatteo |
| 4,970,738 | A | | 11/1990 | Cole |
| 4,987,623 | A | | 1/1991 | Stryker |
| 5,001,789 | A | | 3/1991 | Schoenberger |

5,005,232 A 4/1991 Wright et al.
5,014,399 A 5/1991 Grisel
5,014,968 A 5/1991 Lammers
5,016,306 A 5/1991 Grivna
5,018,225 A 5/1991 Fergni
5,022,810 A 6/1991 Sherrow
5,033,132 A 7/1991 Greenblatt
5,033,170 A 7/1991 Ewert
5,036,557 A 8/1991 Fales
5,038,424 A 8/1991 Carter
5,046,207 A 9/1991 Chamberlain
5,048,133 A 9/1991 Iura
5,050,254 A 9/1991 Murphy
5,054,140 A 10/1991 Bingham
5,060,324 A 10/1991 Marinberg
5,063,624 A 11/1991 Smith et al.
5,065,464 A 11/1991 Blanchard
5,068,931 A 12/1991 Smith
5,072,840 A 12/1991 Asakawa
5,083,331 A 1/1992 Schnelle
5,127,113 A 7/1992 Di Matteo
5,144,284 A 9/1992 Hammett
5,148,558 A 9/1992 Dunn
5,161,276 A 11/1992 Hutton
5,163,189 A 11/1992 DeGray
5,168,587 A 12/1992 Shutes
5,172,442 A 12/1992 Bartley
5,182,827 A 2/1993 Carrier et al.
5,197,156 A 3/1993 Stryker
5,210,887 A 5/1993 Kershaw
5,239,713 A 8/1993 Toivio
5,271,110 A 12/1993 Newman
5,274,862 A 1/1994 Palmer
5,279,010 A 1/1994 Ferrand
5,280,657 A 1/1994 Stagg
5,285,556 A 2/1994 Shorin
5,319,813 A 6/1994 DiMatteo
5,329,655 A 7/1994 Garner
5,329,657 A 7/1994 Bartley
5,331,988 A 7/1994 Harmon
5,340,266 A 8/1994 Hodgetts
5,343,581 A 9/1994 Bartley
5,348,273 A 9/1994 Sandell et al.
5,359,739 A 11/1994 Rains
5,377,391 A 1/1995 Foster
5,379,468 A 1/1995 Cassidy
5,390,379 A 2/1995 Palmer
5,394,576 A 3/1995 Soltani
5,404,602 A 4/1995 Kondo
5,406,658 A 4/1995 Olkkonen
5,428,851 A 7/1995 Shore
5,456,655 A 10/1995 Morris
5,469,588 A 11/1995 DiMatteo
5,482,070 A 1/1996 Kelly
5,511,255 A 4/1996 Schuerch
5,513,406 A 5/1996 Foster
5,522,100 A 6/1996 Schilling
5,524,304 A 6/1996 Shutes
5,530,974 A 7/1996 Rains
5,539,941 A 7/1996 Fuller
5,544,371 A 8/1996 Fuller
5,544,395 A 8/1996 Rosenvinge
5,560,374 A 10/1996 Viard
5,561,878 A 10/1996 Ruehl
5,562,091 A 10/1996 Foster
5,577,279 A 11/1996 Foster
5,608,929 A 3/1997 Crane
5,613,252 A 3/1997 Yu
5,615,425 A 4/1997 Corente
5,615,426 A 4/1997 Hokett
5,630,238 A 5/1997 Weismiller
5,642,537 A 7/1997 Johnson
5,647,079 A 7/1997 Hakamiun
5,651,149 A 7/1997 Garman
5,653,064 A 8/1997 Kappers
5,659,905 A 8/1997 Palmer
5,669,089 A 9/1997 Dees
5,673,443 A 10/1997 Marmor
5,680,661 A 10/1997 Foster
5,682,631 A 11/1997 Weismiller
5,692,272 A 12/1997 Woods
5,694,654 A 12/1997 Roy
5,697,109 A 12/1997 Hodgetts
5,708,997 A 1/1998 Foster
5,715,548 A 2/1998 Weismiller
5,732,423 A 3/1998 Weismiller
5,737,781 A 4/1998 Votel
5,745,937 A 5/1998 Weismiller
5,790,997 A 8/1998 Ruehl
5,802,636 A 9/1998 Corbin
5,802,640 A 9/1998 Ferrand
5,806,111 A 9/1998 Heimbrock
5,819,339 A 10/1998 Hodgetts
5,850,642 A 12/1998 Foster
5,890,238 A 4/1999 Votel
5,901,388 A 5/1999 Cowan
5,937,456 A 8/1999 Norris
5,996,144 A 12/1999 Hodgetts
6,058,533 A 5/2000 Nelson
6,065,162 A 5/2000 Behr
6,108,837 A 8/2000 Knebel
6,128,796 A 10/2000 McCormick
6,282,734 B1 9/2001 Holberg
6,289,533 B1 9/2001 Hodgetts
6,341,393 B1 1/2002 Votel
6,363,555 B1 4/2002 LaRose
6,378,148 B1 4/2002 Votel
D456,751 S 5/2002 Williams
6,393,636 B1 5/2002 Wheeler
6,484,332 B2 11/2002 Korver
6,496,991 B1 12/2002 Votel
6,507,963 B2 1/2003 Hodgetts
6,526,606 B2 3/2003 Friedrich
6,539,569 B2 4/2003 O'Connell
6,560,793 B2 5/2003 Walker
6,591,435 B1 7/2003 Hodgetts
6,615,423 B2 9/2003 Sverdlik
6,629,323 B2 10/2003 Sverdlik
6,658,676 B1 * 12/2003 Persson et al. ..... 5/81.1 HS
6,662,388 B2 12/2003 Friel
6,772,456 B2 8/2004 Votel
7,003,819 B2 * 2/2006 Weigand ..... 5/81.1 HS
2001/0044957 A1 11/2001 Hodgetts
2001/0047543 A1 12/2001 VanSteenburg
2002/0029417 A1 * 3/2002 Walker ..... 5/81.1 R
2002/0029418 A1 3/2002 Votel
2002/0083521 A1 7/2002 Sverdlik
2002/0083522 A1 7/2002 Sverdlik
2002/0134902 A1 * 9/2002 Cheng ..... 248/346.01
2002/0170110 A1 11/2002 Hodgetts
2003/0070226 A1 4/2003 Heimbrock
2003/0074732 A1 4/2003 Hanson
2003/0100559 A1 5/2003 Sikorski
2003/0100560 A1 5/2003 LaVoie
2003/0110559 A1 * 6/2003 Weigand ..... 5/81.1 R
2005/0138727 A1 * 6/2005 Faux et al. ..... 5/81.1 R
2005/0217023 A1 * 10/2005 Tally ..... 5/81.1 HS

FOREIGN PATENT DOCUMENTS

DE 1260692 2/1968
DE 2257572 5/1974
DE 2308436 8/1974
EP 0875228 4/1998
FR 1487854 7/1967
FR 2687065 11/1992

| | | |
|---|---|---|
| FR | 2624007 | 4/1995 |
| GB | 7869 | 5/1895 |
| GB | 26017 | 10/1908 |
| GB | 10012 | 6/1910 |
| GB | 420697 | 12/1934 |
| GB | 1091031 | 11/1967 |
| GB | 1447163 | 8/1976 |
| GB | 2068850 | 8/1981 |
| GB | 2139487 | 11/1984 |
| WO | WO 86/00221 | 1/1986 |
| WO | WO 95/21600 | 8/1995 |
| WO | WO 97/09896 | 3/1997 |
| WO | WO 97/27770 | 8/1997 |
| WO | WO 98/4489 | 10/1998 |

* cited by examiner

DEVICE AND METHOD FOR POSITIONING PATIENTS

FIELD OF THE INVENTION

The invention relates to systems which assist in repositioning patients who are situated on beds, gurneys, or other such patient supports. The invention more particularly relates to systems which give a single health care worker the ability to move a patient from a slumped position to a more elevated or upright position in a patient support.

BACKGROUND OF THE INVENTION

It is often desirable for patients to lie on platforms or patient supports in which the head portion of the platform has been raised or angled upwardly. Often, to obtain the most benefit and comfort from a bed in this raised position, the patient should be disposed such that the patient's abdomen and thorax are in an elevated position. However, elderly, weak, or incapacitated patients tend to slide or slump from this position toward the foot of the bed, thereby losing the healthful benefits of a more upright position. Many are unable to push or pull themselves back to a more comfortable, upright position.

Elderly, weak, or incapacitated persons in hospitals, nursing homes, or other assisted care settings must often be routinely and periodically pulled up from a slumped position when situated in patient supports, such as beds, carts, and gurneys. This pull-up maneuver is typically done manually by two or more attendants, although the number of attendants required to perform a maneuver increases with the weight of the patient. To return the patient to a position more toward the head of the bed, two or more health care workers may either grasp the patient by the upper arms, or grasp the sheet on which the patient is resting, and attempt to lift or drag the patient toward the head of the bed. This manual lifting may cause strain on the workers' upper and lower backs, as well as possible contact bruises on the patient. These lifting events may be necessary for a particular patient several times in a regular shift, requiring that the procedure be repeated.

A typical patient weighs between 45 and 90 kilograms, although many weigh more. These manual lifting activities often create unacceptable risks of injury to healthcare workers, almost without regard to the number of health care workers used in repositioning the patient. The risks are particularly high when a sufficient number of workers are not available to assist in a patient repositioning event. Injuries to workers' backs account for approximately 50% of worker's compensation costs for work place injuries in the health care industry in the United States.

Since a health care worker often has to bend at the waist to accomplish a patient pull-up, the stresses encountered are potentially magnified well beyond what would otherwise be expected for a maximum recommended lift of approximately fifty pounds. Normally this recommended maximum lift is measured with the lift at or near the worker's center of mass. Extremes in a health care worker's height, either taller or shorter than average, or any weakness in either the arms or legs, may further exaggerate these risks. Thus, back injuries to health care workers are a particularly vexing problem.

Given these difficulties, there have been attempts to mechanize the patient pull-up process. Typically, space is limited in hospital and assisted care rooms. Therefore, a device to effect patient pull-ups should preferably occupy a minimum of space or should be incorporated into the design of existing patient supports. Patient pull-ups are typically performed at frequent intervals and it is usually not feasible to transport equipment to and from a room to perform a patient pull-up every few hours, for example.

U.S. Pat. No. 2,827,642, issued to Huff on Mar. 25, 1958, discloses a device for moving a patient on a bed. The device includes a shaft mounted in ball bearing brackets. The brackets are bolted or otherwise secured to the headposts of the bed. Straps for a fabric webbing are secured to the shaft and a fabric supporting section is secured to the straps. A crank handle is removably secured to one end of the shaft. A patient lying on the fabric supporting section is pulled toward the head of the bed by cranking, and thereby winding the straps on, the shaft.

U.S. Pat. No. 5,608,929, issued to Crane on Mar. 11, 1997, discloses a patient-positioning device. The positioning device includes a sheet which is placed under the patient and connected to a rope or braided line. One end of the braided line is anchored to a metal peg on the headboard. The remainder of the braided line is threaded through several pulleys. One of the pulleys is attached to a frame assembly. The patient is pulled up when the head portion of the bed is raised or by an independent motor operating to wind the line.

U.S. Pat. No. 3,597,774, issued to Warren on Aug. 10, 1971, discloses a patient moving device which is attached to hospital beds. The patient moving device includes an adjustable post and clamps for attaching the post to the head of a bed. A winch is mounted on the post. A patient to be pulled up is secured with apron straps and apron tabs are connected to a T-bar. The T-bar is connected to a cable. The winch is operated to wind the cable and pull the patient up. Alternatively, a harness is employed. The harness is arranged under the patient's arm pits and connected to the T-bar before the winch is operated to pull the patient up.

U.S. Pat. No. 4,776,047 issued to DiMatteo on Oct. 11, 1988, discloses a multiple function invalid bed arrangement for transferring a prone patient longitudinally or laterally between beds or surfaces adapted to accept the patient in a prone position. The longitudinal bed transfer is accomplished by equipping the patient's bed with two rollers, one roller at the head and one roller at the foot of the bed. A bed sheet is connected from the head to the foot roller much like a piano roll. The rollers are rotated to transfer the patient to a second bed which is equipped similarly.

U.S. Pat. No. 4,868,938 issued to Knouse on Sep. 16, 1989, discloses a transportable patient mover and moving method. The patient mover moves a patient laterally from a first to a second surface such as from a bed to a gurney. The patient mover includes a bottom stand member and an upstanding support frame carrying an elongated roller. The support frame may be mounted on wheels or casters. One edge of a web-like sheet material is attached to the roller. The other edge of the web material is attached to a clamp. The clamp secures a transfer sheet disposed beneath a patient and the roller winds the web thereon, thereby transferring the sheet and patient thereon.

A need exists for a device which can enable a single attendant to effect patient pull-ups which may either be retrofitted on existing patient supports, or which may be incorporated into the design of future patient supports, such as beds, gurneys, carts, tables, or similar patient supports.

BRIEF SUMMARY OF THE INVENTION

A patient support apparatus having a support frame and a sheet disposed on the support frame, is adapted to support a patient situated on the sheet. A patient pull-up device is operatively coupled to the patient support apparatus, the patient pull-up device comprising a translating device, a frame member operatively coupled to the translating device, and a fastener operatively coupled to the frame member adapted to engage the sheet. The translating device is adapted to move the frame member generally longitudinally with respect to the support frame, thereby moving the patient to a more upright position on the patient support apparatus.

A patient pull-up device according to an embodiment of this invention is adapted to be mounted on or coupled to a patient support, such as a bed, gurney, cart, table, or like patient supports. The patient pull-up device of this invention is contemplated to be used to effect patient pull-ups on patient supports which may be conformable to a generally horizontal position, although patient pull-ups may be effected on patient supports without this capability as well. Embodiments of the invention can be used to effect patient pull-up events on patient supports in which the head portion thereof may be in an elevated position, such as anywhere from about 5 degrees to about 90 degrees from the horizontal.

A patient pull-up device according to an embodiment of the invention comprises a translating device, a frame member operatively coupled to the translating device, and a fastener operatively coupled to the frame member. The patient pull-up device is adapted to be coupled to a patient support apparatus for moving a patient situated on a sheet disposed on the support apparatus. The fastener engages the sheet. The translating device is actuated to move the frame member generally longitudinally to the patient support apparatus, thereby moving the sheet and the patient situated thereon.

A method of moving a person into a more upright position on a support apparatus, according to an embodiment of the invention, includes providing a support apparatus on which a person is situated on a sheet, coupling a pull-up device to the support apparatus, the pull-up device having a fastener, a frame member coupled to the fastener, and a translating device coupled to the frame member, operating the fastener to engage the sheet to the frame member, and operating the translating device to move the frame member longitudinally to the support apparatus, thereby moving the sheet and patient situated thereon into a more upright position.

DETAILED DESCRIPTION OF THE ILLUSTRATED EMBODIMENTS

Figure 1:
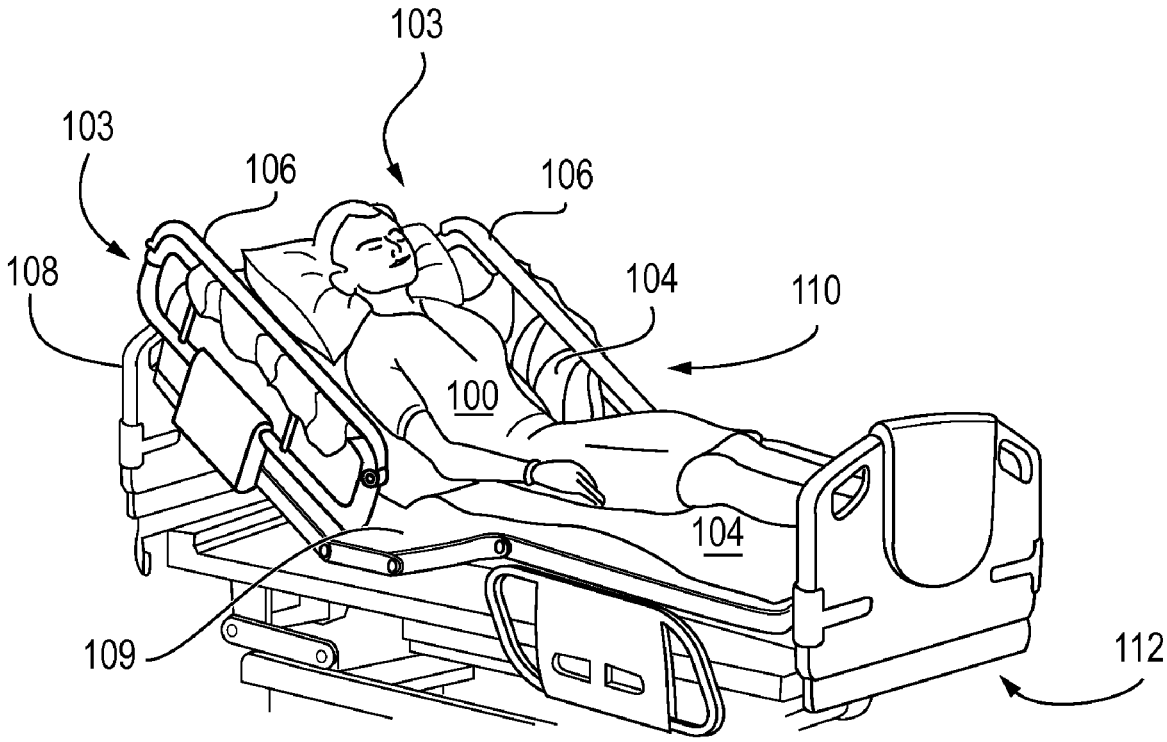
FIG. 1 is a perspective view of a patient pull-up device operatively coupled to a patient support apparatus according to an embodiment of the invention.

The following discussion is presented to enable a person skilled in the art to make and use the invention. Various modifications to the illustrated embodiments will be readily apparent to those skilled in the art, and the generic principles herein may be applied to other embodiments and applications without departing from the spirit and scope of the present invention as defined by the appended claims. Thus, the present invention is not intended to be limited to the embodiments shown, but is to be accorded the widest scope consistent with the principles and features disclosed herein. The following detailed description is to be read with reference to the figures, in which like elements in different figures have like reference numerals. The figures, which are not necessarily to scale, depict selected embodiments and are not intended to limit the scope of the invention. Skilled artisans will recognize the examples provided herein have many useful alternatives which fall within the scope of the invention.

Embodiments of the invention are not limited to patient supports, such as those found in hospitals, for example, and may be adapted for use in other types of supports, such as beds, chairs, and couches. However, for purposes of illustration only, the invention is described below in the context of hospital beds.

FIG. 1 is a perspective view of a patient pull-up device 110 operatively coupled to a patient support apparatus 112 according to an embodiment of the invention. FIG. 1 shows the patient pull-up device 110 installed on a typical patient support 112, such as a hospital bed, gurney, cart, table, or like patient supports. Patient support 112 may be designed to recline over a range of angles to provide patient 100 with a comfortable position with the upper torso of patient 100 raised relative to the rest of the patient's body. Patient 100 is shown in FIG. 1 in a reclined position on the patient support 112 at a suitable angle. Patient support 112 typically has a mattress 109 and sheet 104 disposed thereon. Patient 100 is normally situated on top of sheet 104.

Patient 100 may gradually slide down from a comfortable upright/reclined position into an uncomfortable slumped position, due to the force of gravity. A weak or incapacitated patient may be unable to return themselves to a more comfortable upright position after sliding down into a slumped position. Patient 100 may be periodically returned to a more comfortable position using patient pull-up device 110 to move patient 100 nearer the head of the patient support 112 (i.e., nearer headboard 108 in the embodiment shown in FIG. 1). Patient pull-up device 110 accomplishes this by moving sheet 104, and hence patient 100, toward the head of patient support 112. Patient pull-up device 100 may enable a single healthcare worker to effect such a patient pull-up without placing him/herself at risk of injury, and without causing injury or discomfort to patient 100.

Patient pull-up device 110 comprises several elements which assist in moving sheet 104. As shown in FIG. 1, patient pull-up device 110 may include a frame member, such as a pair of bed rails 103 disposed laterally on either side of patient support 112 (and therefore on either side of patient 100), adapted to engage sheet 104, as described more fully below.

Figure 2:
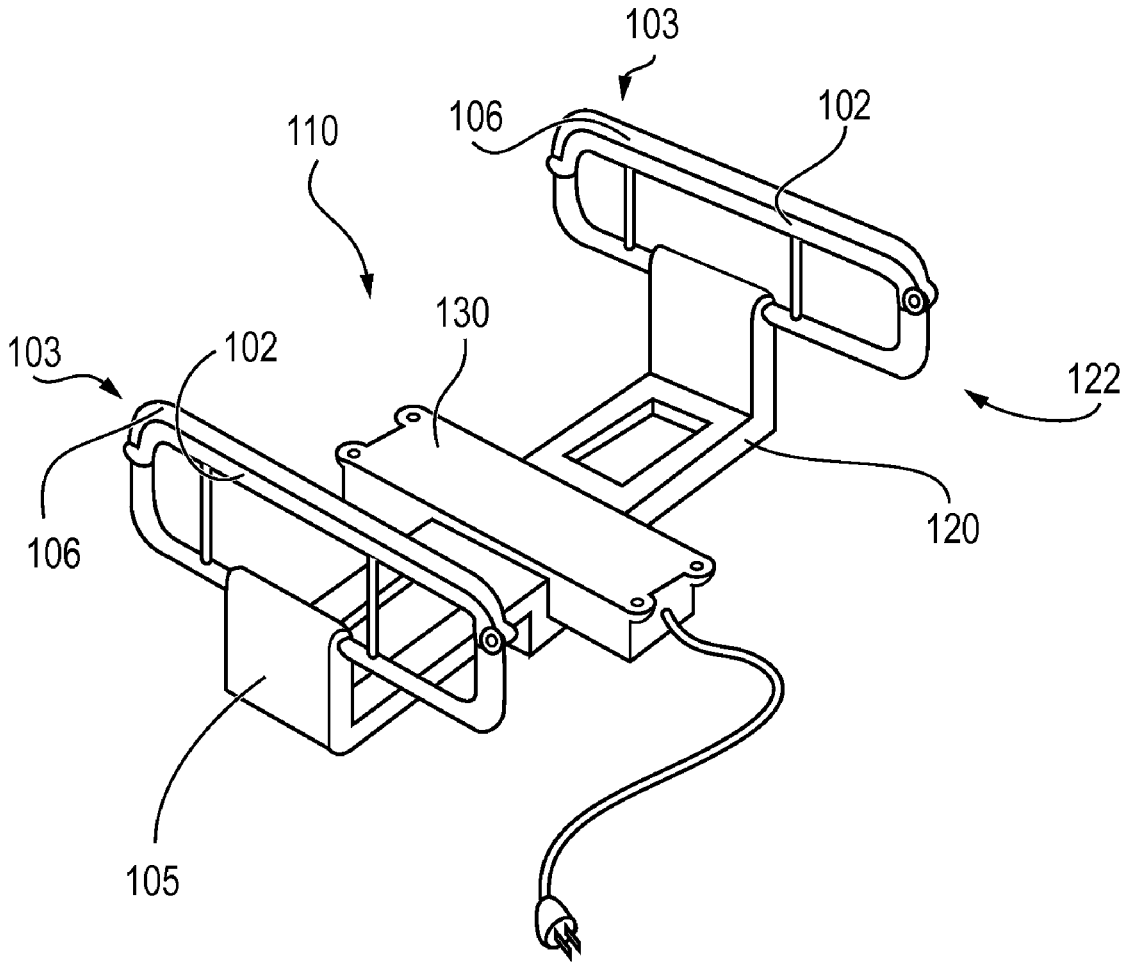
FIG. 2 shows a perspective view of a patient pull-up device according to an embodiment of the invention.

FIG. 2 shows a perspective view of a patient pull-up device 110 according to one possible embodiment of the invention. The patient pull-up device 110 is shown separately from patient support 112 in FIG. 2 to provide additional details. As would be apparent to a person of ordinary skill in the art, the patient pull-up device 110 could be configured as a replacement unit or add-on unit, intended to be retrofit on existing patient supports 112. Alternately, the patient pull-up device 110 could be incorporated into the design and/or manufacture of new patient supports 112 as an integral component thereof. Other suitable combinations of patient pull-up device 110 and patient support 112 may be derived from these teachings by one of ordinary skill in the art without departing from the scope of the invention.

As illustrated in FIG. 2, patient pull-up device 110 comprises a frame member 122, which may include a pair of bed rails 103 disposed on either side of, and operatively coupled to, a beam 120. Beam 120 may be adapted to extend laterally across the width of patient support 112 according to an embodiment of the invention. In an alternate embodiment, frame member 122 may comprise two beams 120, for example a left and right beam (not shown). The left and right beams 120 of such an embodiment may be configured to be moved together as a unit, or independently of each other.

Frame member 122 may include a bed rail 103 on either end as shown in FIG. 2, and may be further adapted to move longitudinally with respect to patient support 112. Translating device 130 is shown operatively coupled to frame member 122 and may house means for providing motive force to move frame member 122. The means for providing motive force may include motors and gear mechanisms as is described more fully in the paragraphs that follow. In one embodiment, translating device 130 may be secured to patient support 112 and may be adapted to provide the motive force to move frame member 122 longitudinally with respect to patient support 112.

Translating device 130 is operatively coupled to frame member 122. Translating device 130 may house a drive mechanism and motor assembly within translating device 130, and may include a configuration of gears adapted to transfer an appropriate amount of torque and speed from the motor within translating device 130 to move frame member 122 relative to patient support 112. A wide variety of motors and drive mechanisms may be utilized and can be appropriately selected for this purpose by one of ordinary skill in the art. Additionally, the motors and drive mechanisms may be selected from among those disclosed in U.S. Pat. Nos. 6,378,148, 6,496,991, and 6,772,456, each of which is herein incorporated by reference in its entirety. Electric, magnetic, hydraulic, and other forms of motors and drive mechanisms may be suitably adapted for use in translating device 130 to provide the motive force for moving frame member 122 relative to patient support 112.

In one embodiment, for example, a worm gear and electric drive motor may be housed within translating device 130 to provide the motive force to move frame member 122. The drive motor may be configured to cause the worm gear to rotate. The rotating worm gear thereby causes horizontal motion of a threadably coupled member within translating device 130 that is operatively coupled to frame member 122, thereby providing horizontal motion to the frame member 122. The direction of motor rotation may also be reversed, thereby reversing the rotation of worm gear and ultimately, reversing the direction of horizontal motion of the frame member 122. The motor may be designed, for example, to apply a slow, steady and constant force to move patient 100 without jerking. The motor may further provide variable speeds of movement consistent with gradual starts and stops and safe movement of the patient throughout the length of travel. Sheet 104 helps distribute forces over significant areas of the patient's body to minimize any localized pressure or pain to patient 100. When patient 100 has been pulled up to a comfortable position, the motor may be turned off or otherwise disengaged.

Translating device 130 may be operated from a control panel (not shown), as is known in the art. The control panel may be located on any suitable portion of patient pull-up device 110, such as on translating device 130, on a portion of frame member 122 such as a bed rail support portion 105, or on a portion of bed rail 103 such as upper portion 102 or fastener (clamp 106), according to the embodiment of the invention depicted in FIG. 2. Alternatively, a portable controller may be utilized, with a flexible cable to deliver control signals to translating device 130, for example. Other embodiments for controlling translating device 130 are possible, including remote control systems as are known in the art.

Frame member 122 may include a bed rail support portion 105 disposed on either end of beam 120 for operatively coupling each bed rail 103 to the frame member 122 as shown in FIG. 2. In certain embodiments, each of the bed rails 103 may be oriented generally longitudinally and generally vertically, as indicated in FIG. 2. It should be noted that bed rails 103 may be hingedly or pivotally coupled to bed rail support portion 105 of frame member 120 such that bed rails 103 may be pivoted to a generally horizontal orientation (not shown). Alternative embodiments of the bed rails 103 may also allow for the bed rails 103 to slide straight down to a lowered position, for example through channels in bed rail support portion 105, and such variations are within the scope of the invention.

Figure 3:
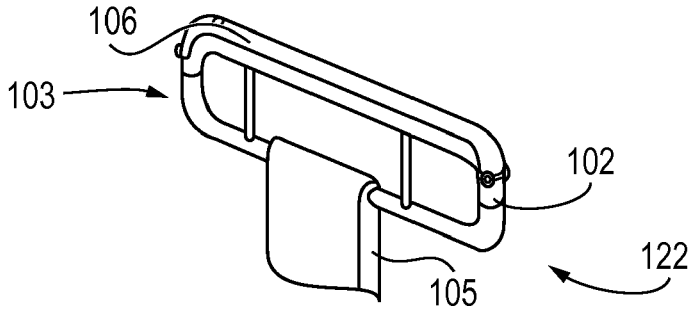
FIG. 3 is a perspective view of a frame member and fastener according to an embodiment of the invention.
Figure 4:
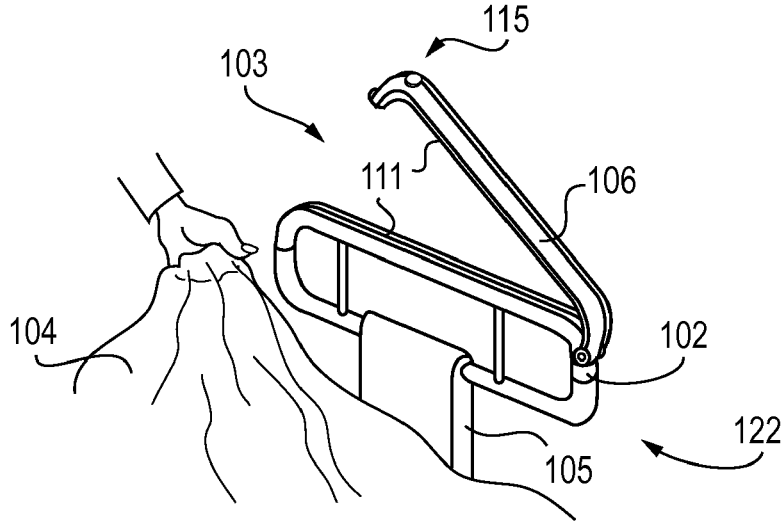
FIG. 4 is a perspective view of a frame member and fastener adapted to receive and engage a sheet according to an embodiment of the invention.
Figure 5:
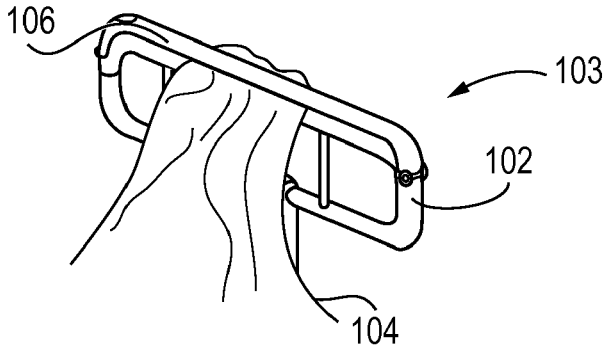
FIG. 5 is a perspective view of a frame member and fastener showing the fastener in the closed or clamped position engaging the sheet with a gripping force.

A portion of frame member 122 is further illustrated in FIGS. 3-5, showing the relationship of bed rail 103 to bed rail support portion 105 of beam 120 (FIG. 2) and to sheet 104 according to an embodiment of the invention. FIG. 3, for example, illustrates a bed rail 103 having a fastener, such as clamp 106, mounted to an upper portion 102 of bed rail 103 according to an embodiment of the invention. As shown in FIG. 3, the fastener is a clamp 106 hingedly or pivotally mounted to an upper portion 102 of bed rail 103. As would be apparent to one having ordinary skill in the art, any suitable fastener may be utilized to engage the sheet 104, such as a hook assembly adapted to engage the sheet 104, for example by a grommeted opening in the sheet 104, or by hook and loop fasteners as are known in the art, or by other suitable means. The following discussion and the associated drawings describe the fastener as clamp 106, but the invention is not so limited. It should also be noted that the following discussion and corresponding references to FIGS. 3-5 describe one of the bed rails 103, the other bed rail 103 being similar in its mechanical design and function.

As noted previously, bed rail 103 may be adapted to engage sheet 104 to effectuate the patient pull-up event. In FIG. 4, bed rail 103 is shown with clamp 106 in an open or unclamped position, exposing frictional surfaces 111 disposed on upper portion 102 of bed rail 103 and on clamp 106. Frictional surfaces 111 are adapted to engage sheet 104 therebetween when clamp 106 is in the closed or clamped position. Frictional surfaces 111 preferably securably fasten sheet 104 to hold sheet 104 during patient movement. Also shown in FIG. 4 is sheet 104 being grasped and pulled toward bed rail 103 by a healthcare worker for placement between frictional surfaces 111.

Clamp 106, depicted in FIGS. 3-5, may be pivotally connected to bed rail 103, for example at one end of upper portion 102, forming a longitudinally pivoting upper member, as shown. Clamp 106 may be configured to pivot onto the upper portion 102 of bed rail 103 with a pivot site disposed at the base of clamp 106 to provide a suitable amount of gripping force to the sheet 104, according to an embodiment. A cam mechanism (not shown) may be incorporated into the pivotal operation of clamp 106 to facilitate applying and adjusting a gripping force to the sheet 104. A rubberized substance or other material with increased tack may be present on the frictional surfaces 111 of clamp 106 and upper portion 102 to increase the gripping force applied to sheet 104. A locking mechanism and/or locking levers may be disposed on bed rail 103 to secure pivoting clamp 106 in a closed or clamped position. Clamp 106 may be biased toward an open position by such means as a leaf or helical spring.

In practice, a healthcare worker may pull a portion of sheet 104 across frictional surfaces 111 exposed between upper portion 102 and clamp 106, as illustrated in FIG. 4. Clamp 106 is then pressed toward upper portion 102 until locking mechanism (not shown) locks, thereby securing clamp 106 to upper portion 102 in a closed, clamped position with sheet 104 gripped securely between frictional surfaces 111.

Clamp 106 and upper portion 102 of bed rail 103 may be adapted to mechanically interlock with one another when clamp 106 is placed in the closed or clamped position. The bed rail 103 may, in certain embodiments, include means for releasing the mechanical interlock, such as by a release button, for example. A release button may be located on clamp 106, for example, where indicated by local controls 115 in FIG. 4. Local controls 115 may also include the control panel for operating translating device 130, according to an embodiment of the invention.

FIG. 5 illustrates the clamp 106 in the closed or clamped position with sheet 104 firmly held by frictional surfaces 111. The sheet 104 is similarly secured by the clamp 106 on the opposite side of patient support 112 (not shown). The patient pull-up device 110 is thus configured to pull patient 100 in a longitudinal direction, typically toward the headboard 108 or head of patient support 112.

There are many possible embodiments of control units for controlling the operation of translating device 130. In one possible embodiment, a remote control unit may be adapted to communicate with translating device 130 by means of electromagnetic radiation, such as by radio frequency, or by other means, and thereby control operation of translating device 130. Other embodiments of control units may communicate with translating device 130 by means of an electrical coupling or other suitable communication means. The cord may mechanically and/or electrically couple the control unit to the translating device 130 and may be disposed on a spool or other retaining means proximate the patient pull-up device 110. In an alternative embodiment, a control unit for the patient pull-up device 110 may be operated via voice actuation as is known in the art. Voice actuation would enable the patient 100 to effect the patient's own pull-up and to halt a transfer in progress if the need to do so arose.

The patient pull-up device 110 may also contain an automatic recording and/or display mechanism for recording each patient pull-up event. Recording may be via a printout on paper, for example to facilitate placement in a patient's chart, or by other means, such as by electronic storage or transfer of information. The stored information may then be transferred to a computer or other device as desired. Information regarding a pull-up event may include the time of day, the patient's number and name, the attendant's name and number, and the time length of the pull-up event. Other items, such as motor performance, speed, acceleration, alignment, or other parameters of the patient 100 or the pull-up device 110 when transferring the patient 100 may also be recorded.

Figure 6:
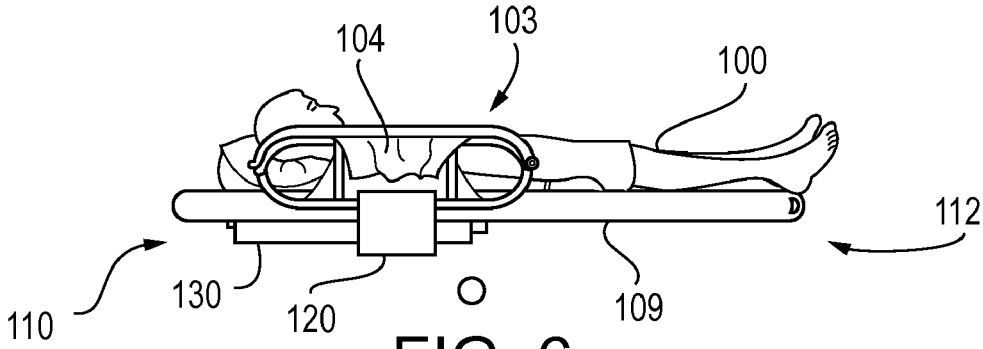
FIG. 6 is a side view of a patient pull-up device operatively coupled to a patient support apparatus with a patient situated thereon, the patient pull-up device positioned to effectuate a patient pull-up event according to an embodiment of the invention.
Figure 7:
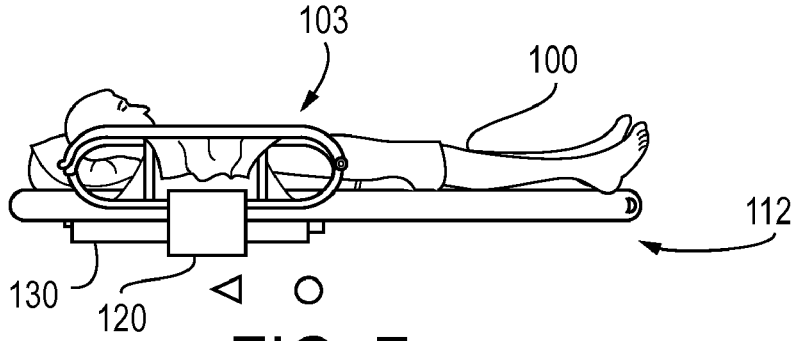
FIG. 7 is a side view of a patient pull-up device with a translating device being activated to reposition a patient to a position nearer the head of the patient support.
Figure 8:
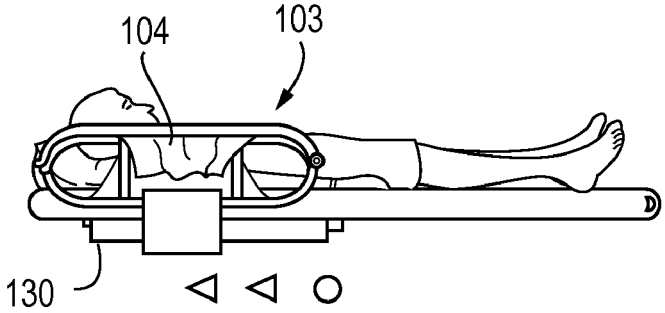
FIG. 8 is a side view of a patient pull-up device near the end of a patient pull-up event according to an embodiment of the invention.
Figure 9:
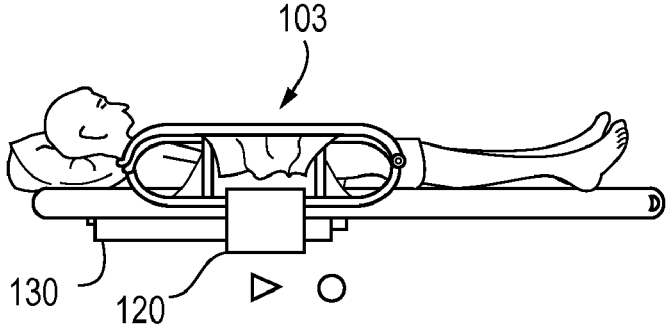
FIG. 9 is a side view of a patient pull-up device in which the translating device has been activated in a reverse direction to move the frame member back into position to effectuate a subsequent patient pull-up.

FIGS. 6-9 illustrate operation of the patient pull-up device 110 as a sequence of discrete steps. A method of effecting a typical patient pull-up is disclosed as shown in FIGS. 6-9 and is described as follows:

FIG. 6: Sheet 104 is securably engaged by clamp 106 located on bed rail 103;

FIG. 7: Translating device 130 is activated to reposition frame member 120 and bed rail 103 nearer the head of patient support 112, thereby moving sheet 104, and hence, patient 100;

FIG. 8: When patient pull-up is complete, translating device 130 is de-activated to stop motion of patient 100, and sheet 104 is released from clamp 106 on bed rail 103; and FIG. 9: Translating device 130 is activated in a reverse direction, moving the frame member 120 and bed rail 103 back into position to effectuate a subsequent pull-up, if needed.

As shown in FIGS. 6-9, patient support 112 has been adjusted to a flat or horizontal configuration with patient 100 situated thereon. Although this may facilitate the patient pull-up event in some circumstances, it is not necessary for operation of patient pull-up device 100.

Referring again to the embodiment shown in FIGS. 3-5, the fastener is illustrated as a longitudinally pivoting member (clamp 106) that extends substantially the entire length of the upper portion 102 of bed rail 103. This embodiment may provide a uniform pulling force over a relatively large portion of sheet 104 due to the relatively large surface area of frictional surfaces 111 in contact with sheet 104. This embodiment may also result in a smoother pull-up motion to the patient 100.

In an alternate embodiment, the fastener may be a clamp, for example, adapted to pivot transversely rather than longitudinally, such that the clamp opens and closes in a direction that is either toward or away from patient 100. A variety of alternative clamp designs as are known in the art may be employed for use as the fastener (rather than clamp 106 as shown in FIGS. 3-5) to hold sheet 104 for the patient pull-up event without departing from the scope of the invention.

Figure 10:
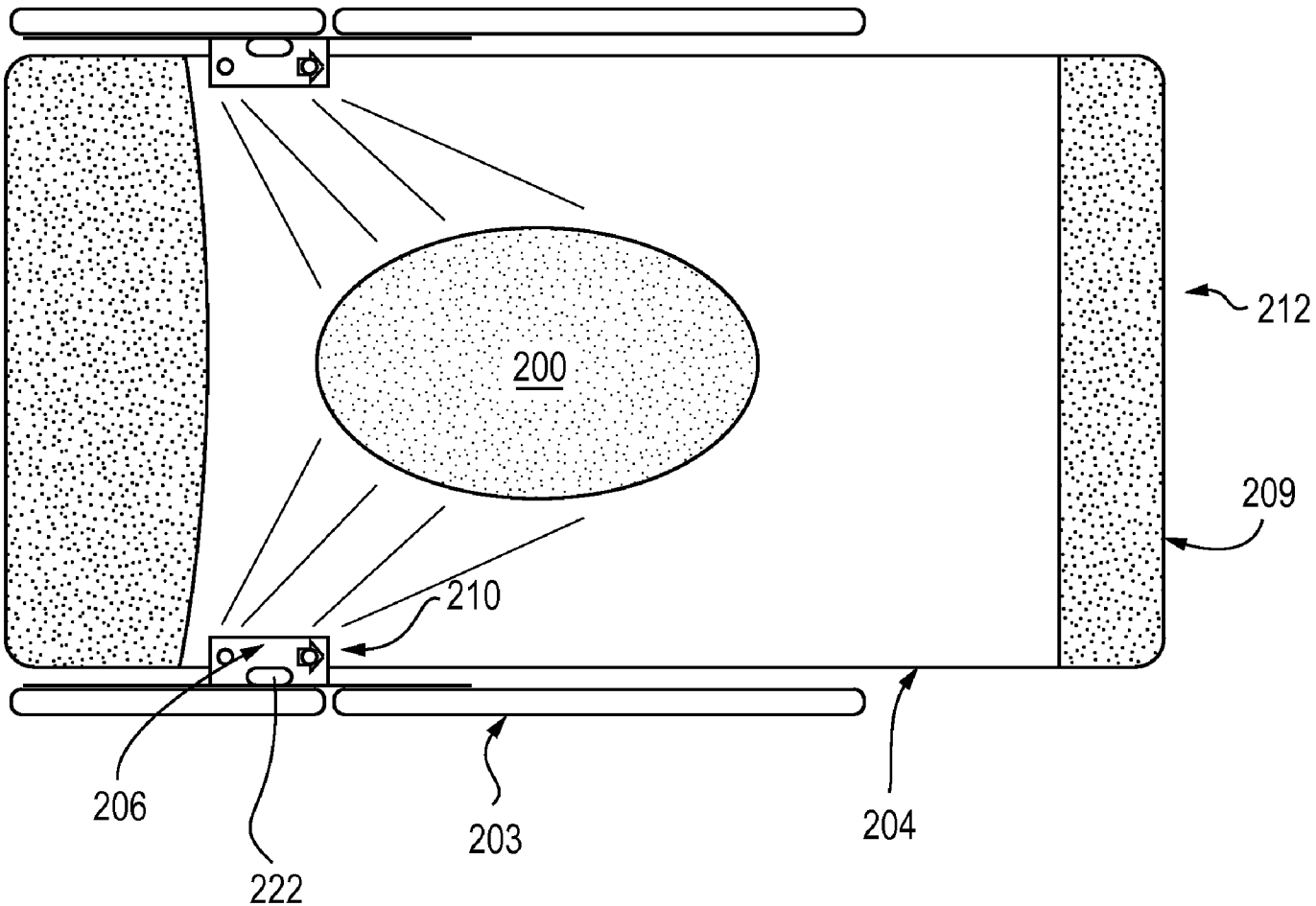
FIG. 10 is a top plan view of patient pull-up device according to an alternate embodiment of the invention.
Figure 11:
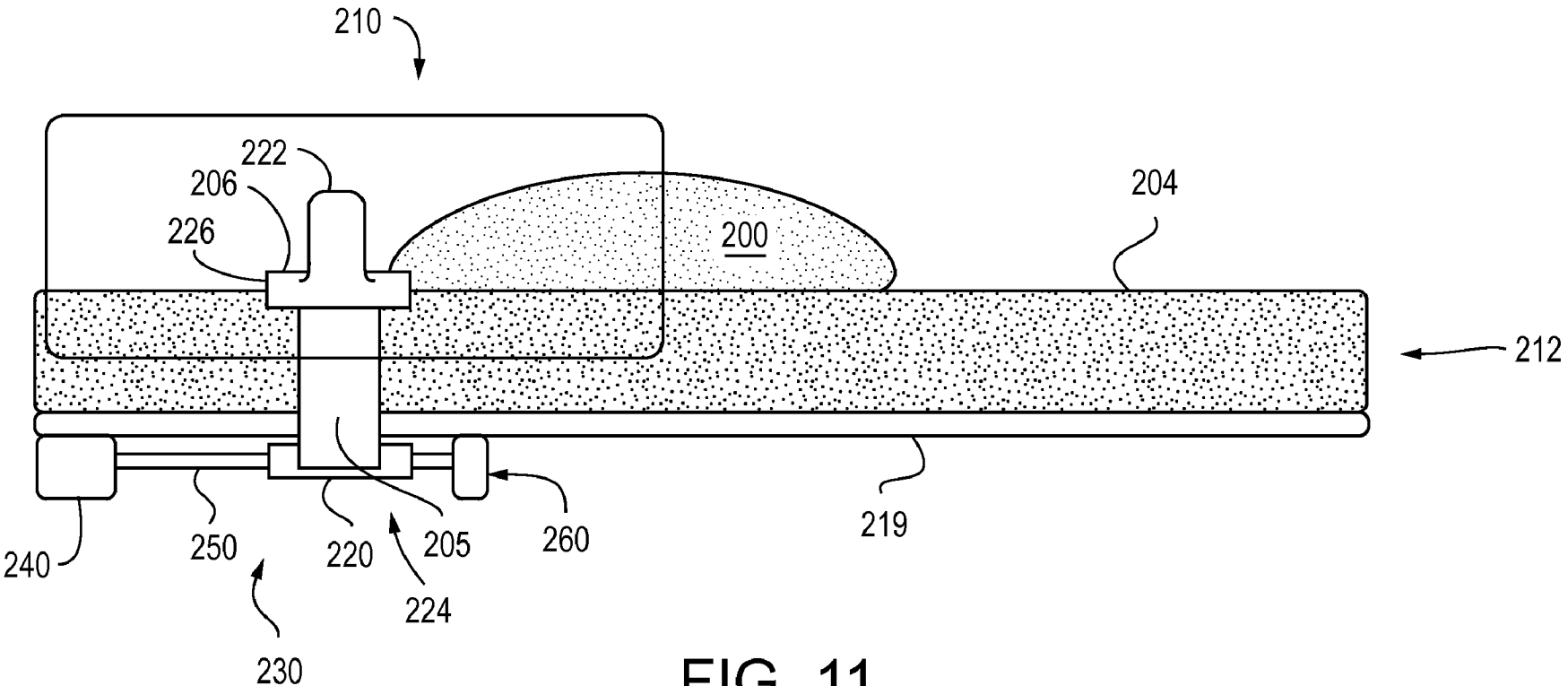
FIG. 11 is a side view of patient pull-up device according to an alternate embodiment of the invention.
Figure 12:
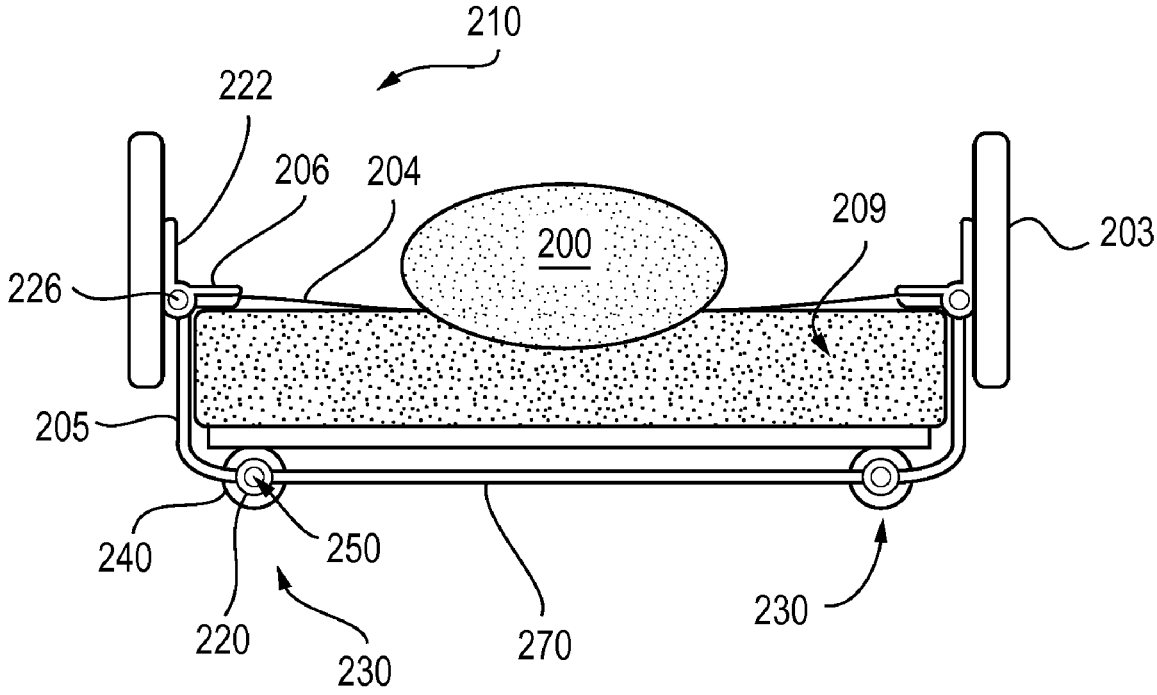
FIG. 12 is an end cross-sectional view of patient pull-up device according to an alternate embodiment.

FIGS. 10-12 show an alternate embodiment of a patient pull-up device configured for use with a patient support such as a hospital bed or gurney. FIG. 10 is a top plan view of patient pull-up device 210 according to an alternate embodiment of the invention. The fastener of this embodiment comprises clamp 206, as shown in FIG. 10, disposed inwardly from bed rail 203 and configured to pivot in a direction transverse to the patient support 212. FIG. 10 also shows a possible overall system configuration, including the location of a patient (shown symbolically at 200) situated on sheet 204 spread across a portion of optional mattress 209 disposed on patient support 212. FIG. 10 also shows optional cam lever 222 for actuating clamp 206 to adjust or improve the gripping force applied by clamp 206 to sheet 204.

FIG. 11 is a side view of patient pull-up device 210 according to an alternate embodiment. A fastener, such as clamp 206, may be operatively coupled to fastener support portion 205 of frame member 224. Frame member 224 may comprise a beam 220 that extends transversely across the patient support 212 with fastener support portions 205 coupled at either end thereto. Clamp 206 may include cam lever 222 and cam pivot 226 to operate clamp 206 and/or control the gripping force applied thereby. FIG. 11 also shows translating device 230 disposed beneath and proximate to optional mattress frame 219 of patient support 212. Translating device 230 may comprise a drive mechanism, which may include a drive motor 240, threaded drive screw 250, and idler bearing 260, as shown in FIG. 11. As would be appreciated by one of ordinary skill in the art, drive mechanisms may comprise electric, magnetic, hydraulic, and other forms of motors and drive assemblies, included those drive mechanisms disclosed in U.S. Pat. Nos. 6,378,148, 6,496,991, and 6,772,456, each of which is herein incorporated by reference in its entirety. An appropriate drive mechanism may be suitably adapted for use in translating device 230 to provide the motive force for moving frame member 224 relative to patient support 212.

FIG. 12 is a cross-sectional view of patient pull-up device 210 according to an alternate embodiment of the invention. In the embodiment depicted in FIG. 12, patient pull-up device 210 comprises an optional second translating device 230, with a separate drive motor 240, threaded drive screw 250, and idler bearing 260 (not shown). Thus, the clamp 206 located on each side of patient pull-up device 210 may be moved longitudinally by an independent translating device 230 according to this embodiment. Optionally, the two translating devices 230 may be interconnected in a manner that allows the two drive motors 240 to share or distribute the load, such as by structured tie 270. Structured tie 270 may include mechanical and/or electrical couplings between the two translating devices 230. The patient pull-up device 210 may be adapted to convert between independent and shared operation of the two translating devices 230, for example by operation of a control unit in communication with one or both of the translating devices 230.

Thus, embodiments of a BED RAIL CLAMP PULL-UP are disclosed. One skilled in the art will appreciate that the present invention can be practiced with embodiments other than those disclosed. The disclosed embodiments are presented for purposes of illustration and not limitation, and the present invention is limited only by the claims that follow.

What is claimed is:

1. A patient pull-up device comprising:

a frame member adapted to be disposed beneath a support frame, the frame member being oriented generally parallel to a lateral axis of the support frame, the frame member having first and second ends that span from at least a right side of the support frame to a left side of the support frame, a first clamp operatively coupled to the frame member near the first end thereof, the first clamp adapted to releasably apply a gripping force to a sheet placed on a top surface of the support frame, a second clamp operatively coupled to the frame member near the second end thereof, the second clamp adapted to releasably apply a gripping force to the sheet, and a translating device adapted to be securably fastened to the support frame, the translating device operatively coupled to the frame member to provide a motive force to move the frame member generally parallel to a longitudinal axis of the support frame to a position nearer a head of the support frame.

2. The patient pull-up device of claim 1 wherein the first and second clamps are adapted to securely grip the sheet pulled therebetween.

3. The patient pull-up device of claim 2 wherein at least one of the first and second clamps pivots to apply a gripping force to a portion of the sheet.

4. The patient pull-up device of claim 3 wherein the gripping force applied to the sheet by the first and second clamps tends to increase when a tension is placed on the sheet.

5. The patient pull-up device of claim 3 wherein the first and second clamps have frictional surfaces to improve the gripping force applied byte first and second clamps to the sheet.

6. The patient pull-up device of claim 1 wherein the first and second clamps have rubberized surfaces to improve a gripping force applied by the first and second clamps to the sheet.

7. The patient pull-up device of claim 2 wherein the first and second clamps are operatively coupled to move together.

8. The patient pull-up device of claim 7 wherein the frame member comprises a beam portion oriented generally parallel to the lateral axis of the support frame, a first rail portion coupled to the beam portion near the first end of the frame member, the first rail portion operatively coupled to the first clamp, and a second rail portion coupled to the beam portion near the second end of the frame member, the second rail portion operatively coupled to the second clamp.

9. The patient pull-up device of claim 8 wherein the beam portion is adapted to be disposed beneath a patient support apparatus, the rail portions extending upwardly from the beam portion, the rail portions spanning from at least the right side of the support frame to the left side of the support frame.

10. The patient pull-up device of claim 1 further comprising a drive mechanism having a hydraulic motor.

11. The patient pull-up device of claim 1 wherein the translating device is adapted to move the frame member via a magnetic coupling.

12. The patient pull-up device of claim 1 wherein the translating device is adapted to be mounted to a bottom surface of the support frame.

13. The patient pull-up device of claim 1 wherein the translating device is adapted to be formed as an integral part of the support frame.

14. The patient pull-up device of claim 1 further comprising a drive mechanism controlled by a remote control unit adapted to communicate with the drive mechanism via radio frequency waves.

15. A method of retrofitting a bed having a support frame, the support frame accommodating a person disposed on a sheet placed on a top surface of the support frame, the support frame having a longitudinal axis and a lateral axis, the longitudinal axis extending from a head of the support frame to a foot of the support frame, the lateral axis extending from a right side of the support frame to a left side of the support frame, the method comprising:

coupling a pull-up device to the support frame, the pull-up device comprising:

a frame member adapted to be disposed beneath the support frame, the frame member being oriented generally parallel to the lateral axis of the support frame, the frame member having fast and second ends that span from at least the right side of the support frame to the left side of the support frame, a first clamp operatively coupled to the frame member near the first end thereof, the first clamp adapted to releasably apply a gripping force to the sheet, a second clamp operatively coupled to the frame member near the second end thereof, the second clamp adapted to releasably apply a gripping force to the sheet, and a translating device adapted to be securably coupled to the support frame, the translating device operatively coupled to the frame member to provide a motive force to move the frame member generally parallel to the longitudinal axis of the support frame to a position nearer the head of the support frame.

16. A method of moving a patient toward the head of the retrofitted bed of claim 15, the method comprising:

pulling the sheet toward the first clamp and operating the first clamp to grip the sheet;

pulling the sheet toward the second clamp and operating the second clamp to grip the sheet; and operating the translating device to move the frame member generally parallel to the longitudinal axis of the support frame to a position nearer the head of the support frame.

17. A patient support comprising:

a support frame having a longitudinal axis and a lateral axis, the longitudinal axis extending from a head of the patient support to a Loot of the patient support, the lateral axis extending from a right side of the support frame to a left side of the support frame, the support frame adapted to support a patient disposed on a sheet placed on a top surface of the support frame; and a patient pull-up device operatively coupled to the support frame, the pull-up device comprising a frame member disposed beneath the support frame, the frame member being oriented generally parallel to the lateral axis of the support frame, the frame member having first and second ends that span from at least the right side of the support frame to the left side of the support frame, a first clamp operatively coupled to the frame member near the first end thereof, the first clamp adapted to releasably apply a gripping force to the sheet, a second clamp operatively coupled to the frame member near the second end thereof, the second clamp adapted to releasably apply a gripping force to the sheet, and a translating device securably fastened to the support frame, the translating device operatively coupled to the frame member to provide a motive force to move the frame member generally parallel to the longitudinal axis of the support frame to a position nearer the head of the patient support.

* * * * *